US007421764B2

(12) United States Patent
Gracer et al.

(10) Patent No.: US 7,421,764 B2
(45) Date of Patent: Sep. 9, 2008

(54) SHOULDER STRAP RING HARDWARE

(75) Inventors: Zoran H. Gracer, Deerfield, IL (US); Donald E. Godshaw, Evanston, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 142 days.

(21) Appl. No.: 11/331,773

(22) Filed: Jan. 13, 2006

(65) Prior Publication Data

US 2007/0163088 A1 Jul. 19, 2007

(51) Int. Cl.
*A44B 11/00* (2006.01)

(52) U.S. Cl. ..... 24/198; 24/200

(58) Field of Classification Search ..... None
See application file for complete search history.

(56) References Cited

U.S. PATENT DOCUMENTS 2,884,675 A * 5/1959 Sternschuss ..... 24/163 R
2,928,154 A * 3/1960 Koehl ..... 24/184
5,307,542 A * 5/1994 Murai ..... 24/200

* cited by examiner

*Primary Examiner*—Robert J Sandy
(74) *Attorney, Agent, or Firm*—Banner & Witcoff, Ltd.

(57) ABSTRACT

Shoulder strap ring hardware is comprised of multiple connected runs made from a hard material such as metal where certain of the runs having a coating or shield of non-abrasive somewhat resilient with an increased effective diameter or radius so that the metal or hard material will be precluded from undesirably engaging against a surface.

6 Claims, 4 Drawing Sheets

FIG.1
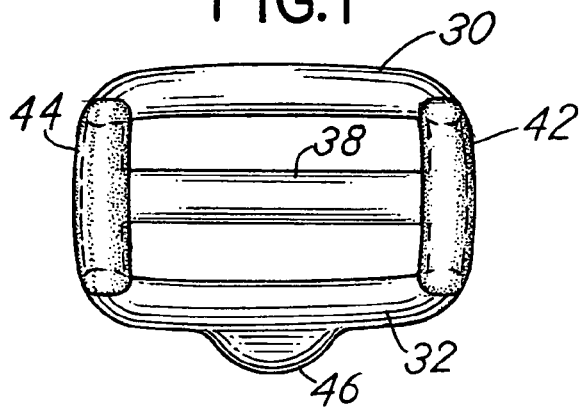
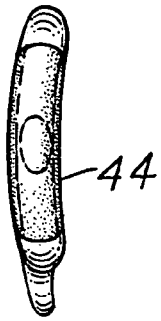
FIG.3
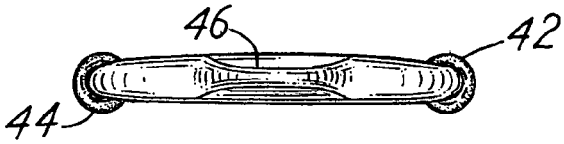
FIG.2
FIG.4
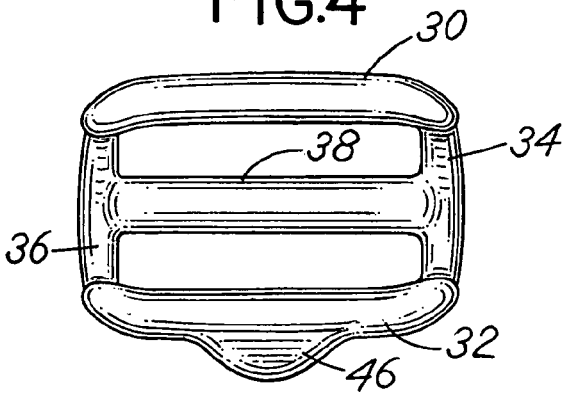
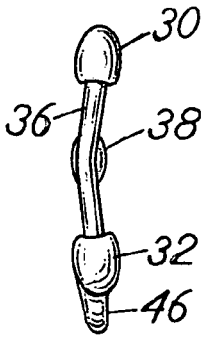
FIG.6
FIG.5
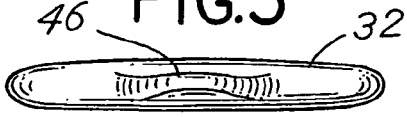

FIG.9
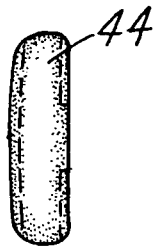
FIG.7
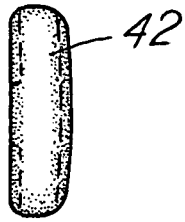
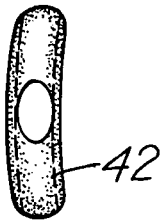
FIG.11
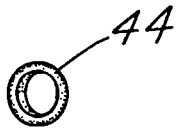
FIG.10
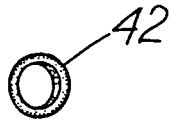
FIG.8
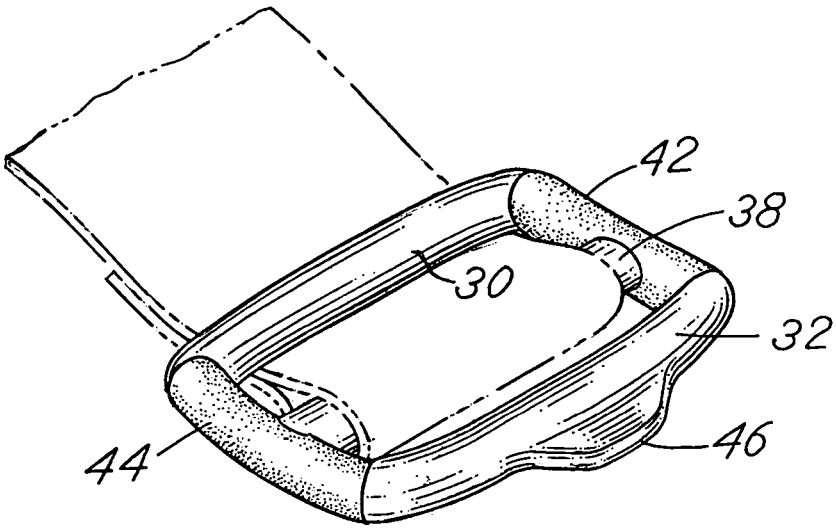
FIG.12

FIG.13
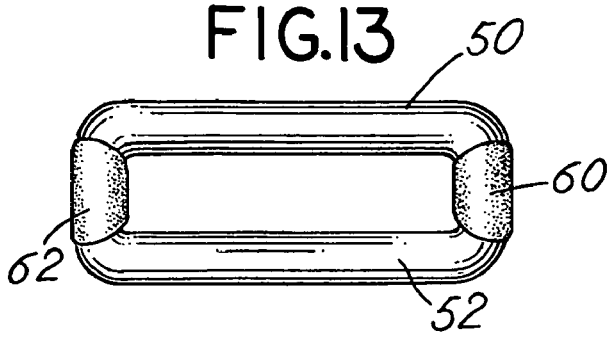
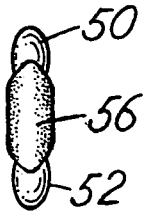
FIG.15
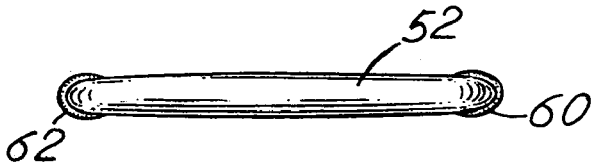
FIG.14
FIG.16
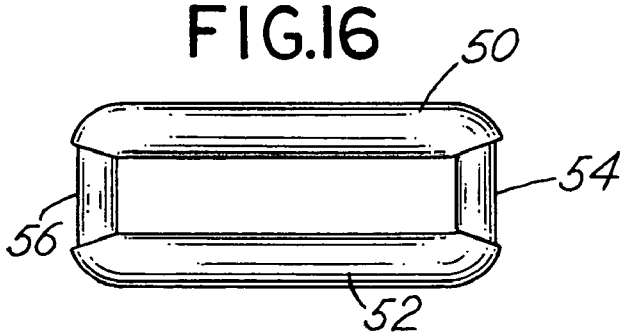
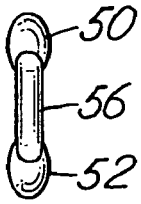
FIG.18
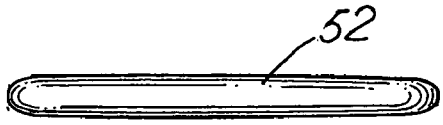
FIG.17

SHOULDER STRAP RING HARDWARE

BACKGROUND OF THE INVENTION

In a principal aspect, the present invention relates to the construction of shoulder strap ring hardware which typically is used in combination with shoulder straps for handbags, luggage and the like.

Adjustable shoulder straps for luggage items, handbags and the like often include hardware in the form of rings through which an adjustable strap or multiple straps are fitted. Such an adjustment ring generally includes one or more cross-bars or internal rungs. A strap can then be fitted through openings defined by the spaced rungs to permit adjustment of the length of the shoulder strap. Typically, such rings for shoulder straps are in the form of a rectangular closed loop though other configurations such as generally circular, ellipsoid and the like are utilized. Also, typically such rings are fabricated or manufactured from metal or alternatively from rigid molded plastic.

One of the problems associated with such rings, particularly those manufactured from metal, is the damage caused by engagement of the metal with a surface or fabric or other material. The hard metal may, for example, dent furniture or otherwise damage items which come in contact with the hardware ring. One solution to this problem has been to cover the ring entirely with a fabric or leather material. This solution however is costly and often is ineffective. Moreover, the fabric cover or other material cover may be removed inadvertently from the ring or hardware member. Also, placing the fabric or leather about the rungs of such a hardware member is often difficult and time consuming. Thus, there has developed a need for an improved hardware or ring construction for shoulder straps and the like.

SUMMARY OF THE INVENTION

Briefly, the present invention comprises hardware for luggage and the like, which is in the form of a solid, unitary metal ring member having a generally closed loop configuration and comprised of generally spaced, parallel peripheral, main runs connected at their opposite ends by spaced connecting runs to form a closed loop. The connecting opposite end runs of the loop include an external layer of plastic generally encircling or molded thereon and extending radially therefrom for a distance greater than the radial dimension associated with the remaining main runs. The end runs which receive the molded plastic outer layer are recessed or have a lesser radial dimension than the uncoated or uncovered main runs. Nonetheless and importantly, the plastic covered end runs have a generally radial dimension or diameter in combination which exceeds the similar dimension of the main runs. Because the plastic covered runs have a greater diameter or radial dimension, the metal runs will not be exposed to or engage undesirably with some surface. Various additional features are incorporated in such hardware or rings. For example, runs may be connected by connecting rungs. The runs may include surfaces which are narrowed or configured so as to appropriately interact in a positive manner with the strap. Further, the runs may include projecting tabs which will facilitate there utility.

Thus, it is an object of the invention to provide improved hardware for use with shoulder straps, luggage straps and the like.

Another object of the invention is to provide a system of luggage ring hardware which is easily manufactured and susceptible to ease of use or utility.

Another object of the invention is to provide hardware useful in combination with shoulder straps, luggage straps and the like, which can include decorative features in combination with utilitarian features.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is a top plan view of a ring or hardware element for straps, which includes three runs or rungs connected by two spaced plastic coated runs.

FIG. 2 is a front end view of the ring of FIG. 1.

FIG. 3 is an end view of the ring of FIG. 1.

FIG. 4 is a top plan view of the metal component of the ring of FIG. 1.

FIG. 5 is a front end or side view of the ring of FIG. 4.

FIG. 6 is a side view of the ring of FIG. 4.

FIG. 7 is a top plan view of the plastic coating element for the ring of FIG. 4.

FIG. 8 is an end view of the plastic element of FIG. 7.

FIG. 9 is a further plastic shroud or coating for the ring of FIG. 4.

FIG. 10 is an end view of the coating of FIG. 9.

FIG. 11 is an end view or side view of the coating of FIG. 9.

FIG. 12 is an isometric view of the ring of FIGS. 1-3.

FIG. 13 is a top plan view of an alternative construction of a ring.

FIG. 14 is a front end view of the ring of FIG. 13.

FIG. 15 is an end view of the ring of FIG. 13.

FIG. 16 is a top plan view of the metal component of the ring of FIG. 13.

FIG. 17 is a front end view of the metal member of FIG. 16.

FIG. 18 is a side view of the metal member of FIG. 16.

DESCRIPTION OF THE PREFERRED EMBODIMENTS

Figure 21:
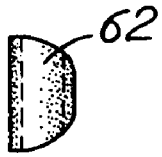
FIG. 21 is an opposite side view to that of FIG. 19 depicting the plastic coating.
Figure 19:
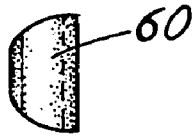
FIG. 19 is a top view of the plastic coating for the ring of FIG. 13.
Figure 22:
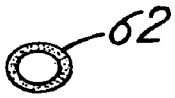
FIG. 22 is an end view of the coating of FIG. 21.
Figure 20:
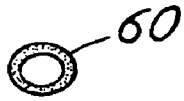
FIG. 20 is an end view of the coating of FIG. 19.
Figure 23:
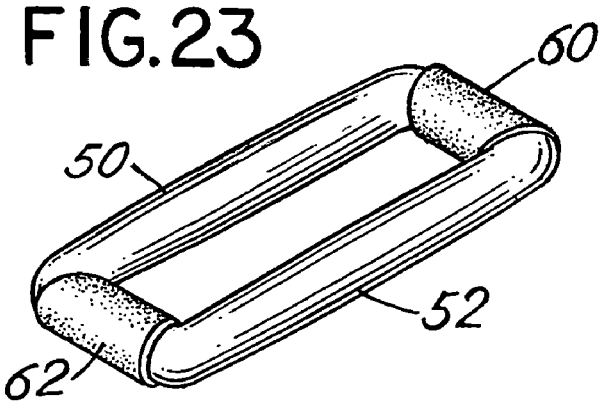
FIG. 23 is an isometric view of the ring of FIG. 13.

FIGS. 1-12 illustrate a first embodiment of the invention. FIGS. 13-23 illustrate a second embodiment of the invention. Each embodiment, however, includes novel features associated with the invention.

Referring to the first embodiment of FIGS. 1-12, the embodiment is comprised of a metal component which may forged, cast or the like as depicted in FIGS. 4-6. Plastic components, which are molded or otherwise formed over the metal component, are illustrated in FIGS. 7-11.

Referring first the metal component, a first main run 30 and a second main run 32 are connected at their opposite ends by connecting cross or end runs 34 and 36. The main runs 30 and 32 are generally parallel, spaced from one another and include a middle rung 38 generally parallel to and midway between them. The ring depicted in FIGS. 4, 5 and 6 includes main runs 30 and 32 which have an external diameter or dimension which is typically greater than the radial dimension or diameter of the connecting end runs 34 and 36.

That is, plastic coating members 42 and 44 are molded or otherwise applied to the reduced diameter end runs 34 and 36 respectively. The radial dimension associated with the outer surface of each of the plastic members 42 and 44 exceeds the radial dimension of the main runs 30 and 32. "Plastic" or "plastic material" comprises non-abrasive, generally resilient materials of lesser hardness than the metal ring with which the material is combined.

The middle run 38 may be of lesser dimension and may also have a non-cylindrical shape for example, as depicted in FIG. 6.

In any event, the component parts are combined to form a ring member, such as illustrated in FIGS. 1, 2, 3 and 12. The plastic coating or outer layer 42 and 44 thus coats or covers the connecting members or end runs 34 and 36 and, as depicted in FIG. 2, provides a radial dimension which maintains a ring member depicted out of contact with a surface. In the embodiment depicted, the end run 32 includes a forwardly extending tab 46 which facilitates gripping of the ring member for adjustment with respect to a strap, for example, as depicted in FIG. 12. Additionally, it is to be noted that the runs 30, 32, 34, 36 and 38 are all generally coplanar. As such, the incorporation of the plastic shield or coating 42 and 44, again serves to protect the ring member from undesirable engagement with a surface because the plastic material is softer and more resilient and will not damage a surface. Additionally, plastic enables easier handling.

As another feature of the invention, the plastic may be color coded in order to provide a decorative aesthetic feature, or alternatively an indication of size or some other characteristic of the ring member. Thus, the combination depicted provides multiple aesthetic and functional options.

FIGS. 13-23 illustrate an embodiment of the invention wherein a single closed loop ring is comprised of a first run 50 and spaced generally parallel to run 52 connected by connecting end runs 54 and 56. The connecting runs 54 and 56 have generally lesser radial dimensions than the main runs 50 and 52 which are designed to interact and engage with straps. The runs 54 and 56 are designed to receive coating or shield material made from plastic. Thus, shield or coating 60 and shield or coating 62 fit over the runs 54 and 56 respectively to provide a construction as depicted, for example, in FIGS. 13, 14, 15 and 23. The radial dimension associated with the combination runs 54, 56 and coatings 60 and 62 therefore exceed the radial dimensions of the other main runs 50 and 52. Again, the coating material 60 and 62 may be of a different color or design.

The dimensions of the various types of rings may be varied without departing from the spirit or scope of the invention. The particular dimensions of the various runs may be varied, as may the configuration of the runs. In the embodiment depicted, the runs are generally straight runs and thus, provide a generally rectangular shape to the rings or hardware disclosed. Other configurations may be utilized however. In the preferred embodiment, the various runs are all coplanar. Additionally, one or more of the runs which are designed to be engaged with straps, may be serrated or include a roughened surface to interact with the strap. Also, the radial dimension of the runs may be varied and the end runs may comprise a metal internal run having a diameter equal to or greater than the main runs, since the plastic shield or coating will still in a greater radial dimension, like the embodiment described above for the end runs. so, opposite end runs with a coating or shield are preferred to insure that no part of the will contact a surface. As a consequence, the subject matter of the invention is to be only by the following claims and equivalents thereof.

What is claimed is:

1. Hardware for use in combination with a flexible strap for adjustment of the strap comprising:

a solid metal ring member including a closed loop configuration of spaced first and second generally opposite runs only connected at their opposite ends by spaced third and forth connection runs;

said third and fourth runs including an external layer of plastic material generally encircling the third and fourth runs and extending radially therefrom at a distance greater than the radial dimension of the first and second runs whereby the external diameter of the third and fourth runs is greater than the external diameter of the first and second runs.

2. The hardware of claim 1 wherein a metal portion of the third and fourth runs have has a radial dimension less than that of the first and second runs.

3. The hardware of claim 1 wherein the ring member is generally rectangular.

4. The hardware of claim 1 wherein the third and fourth runs are joined by a fifth run extending there between generally parallel to and mid way between the first and second runs.

5. The hardware of claim 1 further including a laterally projecting tab from one of the runs.

6. The hardware of claim 1 wherein all the runs are generally coplanar.

* * * * *